US008236747B2

(12) United States Patent
Holzhauer et al.

(10) Patent No.: US 8,236,747 B2
(45) Date of Patent: Aug. 7, 2012

(54) CONSUMER PRODUCT PACKETS WITH ENHANCED PERFORMANCE

(75) Inventors: Fred Holzhauer, Novato, CA (US); Kaj Johnson, Livermore, CA (US); Mike Ratko, Windsor (CA)

(73) Assignee: Method Products, Inc., San Francisco, CA (US)

( * ) Notice: Subject to any disclaimer, the term of this patent is extended or adjusted under 35 U.S.C. 154(b) by 0 days.

(21) Appl. No.: 12/366,778

(22) Filed: Feb. 6, 2009

(65) Prior Publication Data

US 2009/0217462 A1 Sep. 3, 2009

Related U.S. Application Data

(60) Provisional application No. 61/027,319, filed on Feb. 8, 2008.

(51) Int. Cl.

| | |
|---|---|
| ***C11D 17/04*** | (2006.01) |
| ***C11D 3/20*** | (2006.01) |
| ***C11D 3/386*** | (2006.01) |
| ***C11D 3/44*** | (2006.01) |

(52) U.S. Cl. ..... 510/406; 510/218; 510/296; 510/393; 510/407; 510/413; 510/414; 510/445; 510/473; 510/505

(58) Field of Classification Search ..... 510/406, 510/218, 296, 393, 407, 413, 414, 445, 473, 510/505

See application file for complete search history.

(56) References Cited

U.S. PATENT DOCUMENTS

| | | | | |
|---|---|---|---|---|
| 3,186,869 | A | 6/1965 | Friedman | |
| 3,322,674 | A | 5/1967 | Friedman | |
| 3,790,067 | A | 2/1974 | Scheier | |
| 4,188,304 | A | 2/1980 | Clarke et al. | |
| 4,211,668 | A | 7/1980 | Tate | |
| 4,416,791 | A | 11/1983 | Haq | |
| 4,747,976 | A | 5/1988 | Yang et al. | |
| 4,885,105 | A | 12/1989 | Yang et al. | |
| 4,973,416 | A | 11/1990 | Kennedy | |
| 5,422,160 | A * | 6/1995 | Ratko et al. | 428/141 |
| RE34,988 | E | 7/1995 | Yang et al. | |
| 5,679,630 | A | 10/1997 | Baeck et al. | |
| 5,703,034 | A | 12/1997 | Offshack et al. | |
| 5,705,464 | A | 1/1998 | Scheper et al. | |
| 5,962,386 | A | 10/1999 | Scheper et al. | |
| 5,968,881 | A | 10/1999 | Haeggberg et al. | |
| 6,008,166 | A | 12/1999 | Cook et al. | |
| 6,017,871 | A | 1/2000 | Baeck et al. | |
| 6,037,319 | A | 3/2000 | Dickler et al. | |
| 6,136,776 | A | 10/2000 | Dickler et al. | |
| 6,451,750 | B2 * | 9/2002 | Hewitt et al. | 510/297 |
| 6,528,088 | B1 | 3/2003 | Gilleland et al. | |
| 6,649,188 | B2 | 11/2003 | Gilleland et al. | |
| 6,820,626 | B1 | 11/2004 | Jonke et al. | |
| 6,943,143 | B2 * | 9/2005 | Kinloch et al. | 510/503 |
| 6,949,256 | B2 | 9/2005 | Fonkwe et al. | |
| 7,189,843 | B2 | 3/2007 | Tsai et al. | |
| 7,195,777 | B2 | 3/2007 | Stevens et al. | |
| 7,271,141 | B2 | 9/2007 | Kaiser et al. | |
| 7,273,841 | B2 | 9/2007 | Colurciello et al. | |
| 2003/0186829 | A1 | 10/2003 | Maier | |
| 2004/0023826 | A1 * | 2/2004 | Duffield | 510/295 |
| 2005/0084516 | A1 | 4/2005 | Ballard et al. | |
| 2005/0183394 | A1 * | 8/2005 | Hammond et al. | 53/453 |
| 2006/0003913 | A1 | 1/2006 | Boutique et al. | |
| 2006/0172912 | A1 * | 8/2006 | Burt et al. | 510/383 |
| 2006/0281658 | A1 | 12/2006 | Kellar et al. | |
| 2007/0004612 | A1 | 1/2007 | Catlin et al. | |

FOREIGN PATENT DOCUMENTS

| | | | |
|---|---|---|---|
| CA | 1112534 | | 11/1981 |
| EP | 1462514 | A1 * | 9/2004 |
| GB | 2356842 | A * | 6/2001 |
| WO | WO 94/14941 | | 7/1994 |
| WO | WO 03/054121 | A2 * | 7/2003 |

OTHER PUBLICATIONS

International Search Report and Written Opinion based on International Application PCT/US09/33354 (Jul. 7, 2009).

* cited by examiner

*Primary Examiner* — Lorna M Douyon
(74) *Attorney, Agent, or Firm* — Cooley LLP

(57) ABSTRACT

The present invention includes a consumer product packet comprising a capsule and a fill composition within the capsule. The capsule has a tack temperature of about 110° F. or higher and substantially dissolves in water within a predetermined time period at a temperature of about 70° F. or lower. In one example, the capsule comprises a film having at least one polymer, at least one plasticizer, and at least one temperature adjusting agent. Dependent on the fill composition, the consumer product packet may be used for any household or personal use. In one example, the fill composition is a detergent concentrate comprises one or more surfactants, one or more humectants, and a coalescing solvent which has hydrophilic-lipophilic balance (HLB) value from about 7 to about 9, wherein the ratio of the one or more humectants to the coalescing solvent is more than 1.

22 Claims, No Drawings

CONSUMER PRODUCT PACKETS WITH ENHANCED PERFORMANCE

CROSS-REFERENCE TO RELATED APPLICATION

The present application claims priority to U.S. Provisional Application No. 61/027,319, filed Feb. 8, 2008 and entitled "Consumer Product Packets with Enhanced Performance", the content of which is hereby incorporated by reference in its entirety for all purposes.

FIELD OF THE INVENTION

The present invention relates to consumer product packets having versatile usage and enhanced performance.

BACKGROUND OF THE INVENTION

Shell-encapsulated packets have many advantages including the ease of use and handling. For example, the exterior shell or capsule can prevent the consumers from touching the potentially harmful but functional necessary ingredients during the use of the product. However, there are also some challenges for providing shell-encapsulated consumer packets.

One such challenge is high temperature stability of the shell or capsule. Unlike pharmaceutical or biological agents, consumer products for household or personal usage are typically transported or even stored without robust air-conditioning, thus the shell or capsule would be exposed to relatively high temperature for a considerable duration before reaching to the retail market. It is difficult for conventional shells or capsules to stand such a rough condition, e.g., they are likely to become sticky or melt during transportation and storage.

Another challenge is the low temperature dissolution of the shell or capsule in water or neutral aqueous medium. Since the functional ingredients for the intended use are encapsulated in the shell or capsule, it is necessary to release the ingredients from the exterior shell or capsule for the final use. This releasing process is typically accomplished by dissolving the shell or capsule in water. Given the safety concern and energy-saving consideration, it is particularly desirable to use cold water around neutral pH, such as cold tap water. Many of the consumer products are used with appliances having automated cycle, such as the washing cycle of dishwasher or washer for cleaning laundry. It is difficult for conventional shells or capsules to dissolve in cold water around neutral pH, e.g., they may not dissolve fast enough to substantially or completely release the fill composition for its intended use, and thereby present a contamination problem, such as, for example, create a mess to clothes going to a dryer.

Since the preparation of the shell-encapsulated consumer product packet usually involves additional manufacture or assembly process compared to the ready-to-use liquid or solid products, another challenge is to make the consumer product packets quickly and economically.

The shell-encapsulated consumer product packets have wide use in general and are particularly suitable for having concentrated composition encapsulated in shell. However, it is difficult for conventional concentrated composition to be compatible with a shell for consumer products.

SUMMARY OF THE INVENTION

In one aspect, the present invention is directed to a cleaning packet that comprises a capsule and a detergent concentrate within the capsule. The capsule has a tack temperature of about 110° F. or higher and substantially dissolves in water within a time period of about 6 minutes or less at a temperature of about 70° F. or lower.

In another aspect, the present invention is directed to a film-forming composition that comprises at least one polymer or meltable solid or both, at least one plasticizer, and at least one temperature adjusting agent.

In another aspect, the present invention is directed to a detergent concentrate, which is sealable with a polymer-based film at a temperature of about 160° F. or above and comprises no phosphate and less than 15% of water. Preferably, the detergent concentrate comprises one or more surfactants, one or more humectants, and a coalescing solvent which has hydrophilic-lipophilic balance (HLB) value from about 7 to about 9. The ratio between the one or more humectants and the coalescing solvent is more than 1.

DETAILED DESCRIPTION OF THE INVENTION

The present invention provides a consumer product packet that comprises a capsule and a fill composition within the capsule. In other words, the capsule holds and encapsulates the fill composition. It is preferred that the fill composition is in a concentrated form which can be diluted by water or other aqueous diluent for the intended use. The consumer product packet of the present invention has a desirable operating temperature window referred to as Delta T. For the consumer product packet, Delta T is measured by the difference between the tack temperature and the temperature at which the capsule can dissolve in water quickly. By "tack temperature", it is meant the minimum temperature at which a noticeable tack of the capsule is first observed. By "dissolving in water quickly", it is meant the capsule is substantially or completely dissolved by water through dissolution or dispersion within a predetermined time period. The predetermined time period varies depending on the intended use of the consumer product packet and can be from about 1 minutes to about 20 minutes.

The present consumer product packet has such a desirable Delta T operating window that the capsule has a high tack temperature and low temperature for water dissolution. Thus, the present consumer product packet is stable for storage and transportation without air conditioning, and yet can dissolve in water quickly at or below room temperature to serve its functional use. Moreover, since the fill composition is encapsulated by the capsule, it would not be touched by the consumers during use. Thus, the consumers can enjoy using the present packet with convenience and ease. In addition, the concentrated fill composition saves the cost and efforts for the manufactures and consumers in transporting a diluted liquid.

In one embodiment, the capsule has a tack temperature of about 110° F. or higher and substantially dissolves in water within a predetermined time period at a temperature of about 70° F. or lower. The fill composition can be any composition for household or personal use. Examples of suitable use include, but are not limited to household or personal cleaning; gardening; pet-related use; entertainment; oral care; bath and beauty, such as skin/body/hair care; nutritional supplement; and other uses. Examples of the fill composition include, but are not limited to a detergent concentrate, a deodorizer concentrate, a disinfectant concentrate, a colorant concentrate, a flavor concentrate, a surface modifier concentrate, a carwash concentrate, a fabric conditioning concentrate, APC refills concentrate, or a combination thereof. The fill composition can be a solid; a semi-solid; a foamy material, a gel, a paste;

a liquid such as, for example, a solution, a suspension, and a emulsion; or a combination thereof.

In one embodiment of the present invention, the consumer product packet is a cleaning packet which comprises a capsule and a detergent concentrate within the capsule. The capsule has a tack temperature of about 110° F. or higher and substantially or completely dissolves in water within a predetermined time period at a temperature of about 70° F. or lower. By "substantially dissolve", it is meant the capsule is eroded by water through dissolution or dispersion to such an extent that the detergent concentrate within the capsule is substantially released into water. For example, the capsule is dissolved in water to such an extent that about 90% or more of the detergent concentrate is released into water. By "completely dissolve", it is meant the capsule is eroded by water through dissolution or dispersion to such an extent that the detergent concentrate within the capsule is released into water without residue.

In one embodiment, the tack temperature is about 115° F. or higher. In one embodiment, the tack temperature is about 120° F. or higher. In one embodiment, the tack temperature is about 125° F. or higher. In one embodiment, the tack temperature is about 130° F. or higher. In one embodiment, the tack temperature is about 135° F. or higher. In one embodiment, the tack temperature is about 140° F. or higher. In one embodiment, the tack temperature is about 145° F. or higher. In one embodiment, the tack temperature is about 150° F. or higher. In one embodiment, the water temperature for substantially or completely dissolving the capsule is about 80° F., 75° F., 70° F. or lower. In one embodiment, the water temperature for substantially or completely dissolving the capsule is about 65° F. or lower. In one embodiment, the water temperature for substantially or completely dissolving the capsule is about 60° F. or lower. In one embodiment, the water temperature for substantially or completely dissolving the capsule is about 55° F. or lower. In one embodiment, the water temperature for substantially or completely dissolving the capsule is about 50° F. or lower. In one embodiment, the predetermined time period is about 6 minutes. In one embodiment, the capsule is substantially or completely dissolved in water within a time period of 5 minutes or less. In one embodiment, the capsule is substantially or completely dissolved in water within a time period of 4 minutes or less. In one embodiment, the capsule is substantially or completely dissolved in water within a time period of 3 minutes or less. In one embodiment, the capsule is substantially or completely dissolved in water within a time period of 2 minutes or less. In one embodiment, the capsule is substantially or completely dissolved in water within a time period of 1 minutes or less.

In one aspect of the present invention, the capsule is a polymer or meltable solid-based capsule. As used herein, the term "polymer" denotes a naturally occurring or synthetic large molecule including complex carbohydrate; a large molecule made up of a linked series of repeated simple monomers; and other macromolecule substances. Preferably, the polymer is water soluble or dispersible. In one embodiment, the capsule comprises a film having at least one polymer or meltable solid or both, at least one plasticizer, and at least one temperature adjusting agent. The at least one polymer may be a natural polymer, synthetic polymer, or a mixture thereof. Preferably, the at least one polymer is a natural polymer, i.e., a polymer not derived from petroleum sources. Examples of the at least one polymer includes, but is not limited to gelatins, cellulose based polymers, natural gums, polyvinyl alcohol, poly (ethylene oxide) polymers, starches, water soluble carbohydrates, seaweed extracts, and combinations thereof. By "meltable solid", it is meant any substance that has a low melting point and melt under heat. Examples of meltable solid include, but are not limited to fatty acids or their salts, sterate, soy wax, and combinations thereof.

The term "natural gums" as used herein denotes polysaccharides of natural origin that are capable of causing a large viscosity increase in solution, even at low concentrations. Examples of natural gums include, but are not limited to beta-glucan, chicle gum, dammar gum, gellan gum, glucomannan, guar gum, gum arabic, gum ghatti, gum tragacanth, karaya gum, locust bean gum, mastic gum, psyllium seed husks, spruce gum, tara gum, xanthan gum, and a combination thereof. As used herein, seaweed extracts include any products obtained from seaweed through extracting any types of seaweed. Examples of seaweed extracts include agar, alginic acid, carrageenan, sodium alginate, and a combination thereof.

The term "plasticizer" as used herein refers to any additive that increase the plasticity or fluidity of the material to which they are added. While any plasticizer known to one skilled in the art can be used in the present invention, suitable examples of plasticizer include, but are not limited to glycerine, water, propane diol, sorbitol, polyol, and a combination thereof.

The term "temperature adjusting agent" as used herein denotes a material capable of increasing the tack temperature of the capsule, or lowering the temperature at which the capsule is dissolved in water within a predetermined period of time, or both. Examples of temperature adjusting agent include, but are not limited to an organic acid or its salt or a mixture thereof, starch, modified starch, a hygroscopic sugar alcohol, and a combination thereof. The salt may be formed by reacting the organic acid with a base. Examples of salts include, but are not limited to alkali salts, such as sodium and potassium salts; non-alkali salts, such as calcium, magnesium, and other metal salts; and amine salts.

By "organic acid", it is meant an organic compound with acidic properties. It is preferable that the organic acid is an organic compound having the carboxylic acid functional groups. Examples of organic acid includes, but are not limited to acetic acid, citric acid, succinic acid, maleic acid, fumaric acid, malic acid, tartaric acid, tannic acid, lactic acid, glycolic acid, or a combination thereof. It is more preferable that the organic acid is citric acid.

The term "sugar alcohol" refers to hydrogenated form of carbohydrate, whose carbonyl group has been reduced to a primary or secondary hydroxyl group. A typical formula of sugar alcohol is $H(HCHO)_{n+1}H$. Examples of hygroscopic sugar alcohol include, but are not limited to maltitol, sorbitol, maltodextrin, erythritol, arabitol, xylitol, mannitol, isomalt, lactitol, and a combination thereof.

Dependent on the intended use and the fill composition to be encapsulated, the at least one polymer, at least one plasticizer, and ate least one temperature adjusting agent may be in various percentages and ratios. In one embodiment, based on the weight of the film, there are from about 10% to about 90% of the at least one polymer, from about 10% to about 60% of the at least one plasticizer, and from about 0.1% to about 15% of at least one temperature adjusting agent in the film. In another embodiment, the at least one polymer is from about 20% to about 80%, the at least one plasticizer is from about 15% to about 55%, and the at least one temperature adjusting agent is from about 0.3% to about 12%. In another embodiment, the at least one polymer is from about 30% to about 70%, the at least one plasticizer is from about 20% to about 50%, and the at least one temperature adjusting agent is from about 0.5% to about 9%. In another embodiment, the at least one polymer is from about 40% to about 60%, the at least one plasticizer is from about 30% to about 40%, and the at least one temperature adjusting agent is from about 0.7% to about 6%.

In another aspect of the present invention, the detergent concentrate within the capsule comprises no phosphate. In another aspect of the present invention, the detergent concentrate within the capsule has a very low total water concentration. By "very low total water concentration", it is meant a total water concentration of about 15% or less based on the weight of the detergent concentrate. In one embodiment, the total water concentration is about 12% or less. In one embodiment, the total water concentration is about 9% or less. In one embodiment, the total water concentration is about 5% or less. In one embodiment, the total water concentration is about 2% or less. In one embodiment, the detergent within the capsule comprises less than about 1% of total water. By "total water", it is meant to include both the water molecules that can freely move around in the detergent composition, i.e., "free water", and the water molecules the movement or activity of which is substantially weakened or reduced by their interaction with other ingredients. It is noted that certain ingredients of the capsule film, such as the plasticizer and the temperature adjusting agent, may limit the activity of the water molecules in the detergent concentrate via adsorption, forming hydrogen bonds, or interacting with the water molecules by other physiochemical means. That is, not only the detergent has a very low total water concentration, but the capsule film further limits the water activity by "locking" the water molecules. Thus, the detergent concentrate has an ultra low free water concentration, and thereby constitutes an anhydrous or almost anhydrous condition in effect. It is preferred that the free water concentration is less than about 2% with the range of less than about 1% more preferred. On the other hand, the anhydrous or almost anhydrous detergent concentrate helps maintain the dryness of the capsule and thereby improves the stability of the capsule during storage and transportation and lowers the temperature at which the capsule can dissolve in water quickly. Such a synergistic effect can be achieved or optimized by adjusting the percentage and/or ration of various ingredients in the capsule film and detergent concentrate.

In one embodiment of the present invention, the detergent concentrate comprises one or more surfactants, one or more humectants, and a coalescing solvent which has hydrophilic-lipophilic balance (HLB) value from about 7 to about 9, wherein the ratio of the one or more humectants to the coalescing solvent is more than about 1.

The one or more surfactants suitable for the present invention can be any surfactant known to one skilled in the art including, but not limited to non-ionic surfactants, anionic surfactants, cationic surfactants, amphoteric surfactants, zwiterionic surfactants, or combinations thereof. Preferably, the one or more surfactants are non-ionic surfactants, anionic surfactants, or combinations thereof. Examples of the non-ionic surfactant include, but are not limited to alkoxylates of saturated or mono- or poly-unsaturated linear or branched-chain alcohols having from 10 to 22 carbon atoms. Examples of the anionic surfactants include, but are not limited to alkyl or alkenyl sulfates or sulfonates, the alkyl or alkenyl ether sulfates or sulfonates, or combinations thereof wherein the alkyl or alkenyl group has from 8 to 22 carbon atoms.

The term "humectant" includes any hygroscopic substance. In one embodiment, the one or more humectants are also hydrotropes. By "hydrotrope", it is meant a compound that can solubilize hydrophobic compounds in aqueous solutions. Examples of humectant include, but are not limited to one or more alkyl alcohols, such as, for example, methanol, ethanol, 1,3 propane diol, glycerin, propylene glycol, sorbitol, and combinations thereof.

The coalescing solvent can be any organic solvent known to or used by one skilled in the art for coalescing purpose. Examples of the coalescing solvent include, but are not limited to propylene-based glycol ethers, such as propylene glycol monomethyl ether, dipropylene glycol monomethyl ether, tripropylene glycol monomethyl ether, propylene glycol monobutyl ether, and a combination thereof.

In one embodiment of the present invention, the detergent concentrate further comprises a non-phosphate builder. The non-phosphate builder may be organic or inorganic substance. Examples of non-phosphate builder include, but are not limited to sodium carbonate, calcium carbonate, magnesium carbonate, ethylenediaminetetraacetic acid (EDTA), nitriloacetic acid (NTA), borates, zeolites, alkyl or hydroxyalkyl cellulose derivatives, and combinations thereof. Preferably, the non-phosphate builder is an alkyl cellulose derivative, hydroxyalkyl cellulose derivative, carboxyalkyl cellulose derivative, or a combination thereof, Alkyl, hydroxyalkyl, carboxyalkyl cellulose derivatives are cellulose chemically modified by alkyl, hydroxyalkyl, or carboxyalkyl groups. Examples of an alkyl, hydroxyalkyl, and carboxyalkyl cellulose derivatives include, but are not limited to methyl cellulose, hydroxypropyl ether cellulose, carboxy methyl ether cellulose or its alkali salt or a mixture thereof, and a combination thereof.

In one embodiment of the present invention, the detergent concentrate further comprises one or more digestive enzymes. Digestive enzymes can by any enzyme in the alimentary tract that break down food or other organic materials so that the organism can absorb it. Examples of the digestive enzyme include, but are not limited to one or more protease enzymes, one or more amylase enzymes, one or more cellulase enzymes, one or more lipase enzymes, one or more manninase enzymes, and combinations thereof. In one embodiment of the present invention, the detergent concentrate further comprises means or substance to stabilize the digestive enzyme. For example, the digestive enzymes may be encapsulated or coated or be processed otherwise.

In one embodiment of the present invention, the detergent concentrate further comprises one or more fragrant compounds or ingredients.

Dependent on the intended use and the outside capsule film, the ingredients of the detergent concentrate, such as the one or more surfactants, the one or more humectants, the coalescing solvent, the non-phosphate builder, the one or more digestive enzymes, the one or more fragrant ingredients may be in various percentages and ratios.

In one embodiment of the present invention, based on the weight of the detergent concentrate, there are from about 65% to about 90% of one or more surfactants, from about 2% to about 12% of one or more humectants, and from about 1% to about 6% of a coalescing solvent in the detergent concentrate. In one embodiment of the present invention, there are from about 70% to about 85% of one or more surfactants, from about 4% to about 10% of one or more humectants, and from about 2% to about 5% of a coalescing solvent in the detergent concentrate. In one embodiment of the present invention, there are from about 75% to about 80% of one or more surfactants, from about 6% to about 8% of one or more humectants, and from about 3% to about 4% of a coalescing solvent in the detergent concentrate.

In one embodiment of the present invention, based on the weight of the detergent concentrate, there is from about 0.5% to about 1.5% of a non-phosphate builder in the detergent concentrate. In another embodiment of the present invention, there is about 1% of a non-phosphate builder in the detergent concentrate. In one embodiment of the present invention, based on the weight of the detergent concentrate, there is from about 1.5% to about 3.5% of one or more digestive enzymes. In another embodiment of the present invention, there is from about 2% to about 3% of one or more digestive enzymes. In one embodiment of the present invention, the detergent concentrate comprises from about 0.2% to about 3% by weight of fragrant compounds.

In one embodiment, the detergent concentrate comprises at least 4 fold of a predetermined final concentration. That is, one part of the detergent concentrate may be diluted by adding 3 parts or more of water or other aqueous diluent to make the final detergent concentration for the intended use. In one embodiment, the detergent concentrate comprises at least 5 fold of a predetermined final concentration. In one embodiment, the detergent concentrate comprises at least 6 fold of a predetermined final concentration. In one embodiment, the detergent concentrate comprises at least 7 fold of a predetermined final concentration.

Although not critical to its intended use and performance, it is preferred that the cleaning packet and all its components including the capsule, the detergent concentrate, and the ingredients thereof, are environmentally friendly. For example, it is preferred, although not critical, the cleaning packet contains material derived from natural, not petroleum, sources. It is also preferred, although not critical, that all the components of the cleaning packet can be degraded through biological or natural processes and not accumulate in the environment.

In another aspect, the present invention provides a container containing one or more capsules as described above. The container may be in any shape or size depending on the intended use and other functional consideration. For example, the container may be in a shape that is space-saving for storage or transportation purposes, or in a shape that can be easily held/grabbed by a consume for convenience of use, or both. In one embodiment of the present invention, the container has an opening and is in such a shape that a consumer's hand can easily reach in and take any of the capsules inside the container. In another embodiment of the present invention, the container is in a shape to serve as a dispenser, and thereby the consumer's hand does not need to reach inside the container for distributing the capsules. In another embodiment of the present invention, the container is in a shape which allow stacking. In one embodiment of the present invention, the container comprises a chamber for each capsule. The container may be made of any material depending on the intended use and other functional consideration. Examples of suitable material include, but are not limited to glass, plastic, wood, metal, alloy, fabric, porcelain, clay, polymer, and combinations thereof. Preferably, the container is made of a recyclable material. The container may also be in any form suitable for consumer products. Examples of the suitable form include, but are not limited to canister, pouch, box, etc. The container may comprise an opening with a lid, zip, or other means to open and close the opening as needed. The lid may optionally be a hinged lid, such as a flip-top. The container may optionally comprise a handle.

In one aspect, the present invention provides a method for cleaning a non-textile surface. The method comprises adding the above-described cleaning packet to a volume of water to dissolve the capsule and dilute the detergent concentrate within the capsule to form an aqueous cleaning composition; and applying the aqueous cleaning composition to a non-textile surface to clean the surface.

In one aspect, the present invention provides a method for cleaning laundry. The method comprises adding the cleaning packet of claim 1 to a volume of water to dissolve the capsule and dilute the detergent concentrate within the capsule to form an aqueous cleaning composition; and applying the aqueous cleaning composition to a laundry to clean the laundry.

In another aspect, the present invention provides a film-forming composition. The film-forming composition can be used to prepare a capsule having a desirable Delta T operating window as described above. The capsule may be filled with any composition for household or personal use including, but not limited to the fill composition of the present invention. Preferably, the fill composition is in a concentrated form that can be diluted with water or aqueous diluent for the intended use. In one embodiment, the film-forming composition comprises at least one polymer, at least one plasticizer, and at least one temperature adjusting agent, as described above. It is preferred that the at least one polymer is a natural polymer, a synthetic polymer, or a combination thereof. The definitions for and the percentages/ratios of the polymer, the plasticizer, the temperature adjusting agent, and other optional ingredients are the same as described above.

In another aspect, the present invention provides a fill composition which is sealable with a polymer-based film at a temperature of about 160° F. or above (i.e., about 70° C. or above). In one embodiment, the fill composition is sealable with a polymer-based film at a temperature of about 90° C. or above. In another embodiment, the fill composition is sealable with a polymer-based film at a temperature of about 130° C. or above. The fill composition has a very low total water concentration and an ultra low free water concentration. The terms "very low total water concentration", "total water", and "free water" have the same definition as described above. In one embodiment, the total water concentration is about 12% or less. In another embodiment, the total water concentration is about 9% or less. In another embodiment, the total water concentration is about 5% or less. In another embodiment, the total water concentration is about 2% or less. In yet another embodiment, the detergent within the capsule comprises less than about 1% of total water. It is preferred that the free water concentration is less than about 2% with the range of less than about 1% more preferred. The present fill composition may be used with any capsule with a polymer-based film including, but not limited to the capsule of the present invention. The fill composition is for household and personal use and is preferred to be in a concentrated form. Examples of the fill composition include, but are not limited to a detergent concentrate, a deodorizer concentrate, a disinfectant concentrate, a colorant concentrate, a flavor concentrate, a surface modifier concentrate, or a combination thereof. The fill composition can be a solid; a semi-solid; a paste; a liquid such as, for example, a solution, a suspension, and a emulsion; or a combination thereof. In one embodiment of the present invention, the fill composition is a detergent concentrate comprising one or more surfactants, one or more humectants, and a coalescing solvent which has hydrophilic-lipophilic balance (HLB) value from about 7 to about 9, wherein the ratio between the one or more humectants and the coalescing solvent is more than 1, as described above. The definitions for and the percentages/ratios of the surfactants, the humectants, the coalescing solvent, and other optional ingredients are the same as described above.

Unlike many prior art fill compositions which are sealed with a film by using a sealing agent, such as an adhesive, the present fill composition can be sealed with a polymer-based film via heat or pressure or both without any sealing agent. In one aspect, the present invention provides a method of sealing a detergent concentrate with a polymer-based film comprising sealing the detergent concentrate as described above in a capsule comprising a polymer-based film. The sealing of the detergent concentrate does not require a sealing agent and may be carried out by applying heat or pressure or both. Such a self-sealing feature not only offers cost-effective advantage for the present consumer product packet by streamlining the manufacturing process, but also enables the preparation of the present capsule in a shape having aesthetically appealing contour. Specifically, the present capsule can be prepared with a smooth surface having no hard edges.

The capsule and the fill composition of the present invention may be prepared by any method or procedure commonly used by or otherwise known to one skilled in the art. The consumer product packet of the present invention may be assembled by an encapsulation machine or other instruments commonly used by or otherwise known to one skilled in the art.

Table 1 below lists the ingredients of four exemplifying film-forming compositions. Capsules made from these film-forming compositions displayed improved Delta T operating window compared to the prior art capsules.

TABLE 1

| Film-forming Composition | | | | |
|---|---|---|---|---|
| Ingredients | No. 1 | No. 2 | No. 3 | No. 4 |
| Porcine gelatin | 40.5% | 40.5% | 40.5% | 40.5% |
| Carageenan | 5% | X | X | X |
| Maltitol | X | 5% | X | X |
| Maltodextrin | X | X | 5% | X |
| Sorbitol 70% aq. | X | X | X | 7.1% |
| Glycerin | 21.8% | 21.8% | 21.8% | 21.8% |
| Water | 25.6% | 25.6% | 25.6% | 23.5% |
| Other fillers | 7.1% | 7.1% | 7.1% | 7.1% |

Table 2 below lists the ingredients of one exemplifying detergent concentrate composition, which was sealed with a polymer-based film without using a sealing agent.

TABLE 2

| Detergent Concentrate Composition | |
|---|---|
| Ingredients | Percentage |
| C12-C14 linear alcohol ethoxylate 7.2 mole EO | 55% |
| glycerin | 4% |
| dipropylene glycol monomethyl ether | 7% |
| fragrance compounds | 2.25% |
| potassium salt of coconut acid | 0.25 |
| sodium salt of secondary alkane (C12-C17) sulfate | 14.5 |
| ethoxylated soybean oil methyl ester 12 moles EO | 14.6 |
| protease enzyme | 0.80 |
| protease enzyme | 0.80 |
| amylase enzyme | 0.80 |

The terms "a" and "an" do not denote a limitation of quantity, but rather denote the presence of at least one of the referenced item. The term "or" or "and/or" is used as a function word to indicate that two words or expressions are to be taken together or individually. The terms "comprising", "having", "including", and "containing" are to be construed as open-ended terms (i.e., meaning "including, but not limited to"). The endpoints of all ranges directed to the same component or property are inclusive and independently combinable.

While the present invention has been particularly shown and described with respect to preferred embodiments thereof, it will be understood by those skilled in the art that the foregoing and other changes in forms and details may be made without departing from the spirit and scope of the invention. It is therefore intended that the present invention not be limited to the exact forms and details described and illustrated but fall within the scope of the appended claims.

We claim:

1. A cleaning packet comprising a capsule and a detergent concentrate within the capsule, wherein the capsule has a tack temperature of about 110° F. or higher and dissolves in water from about 1 to about 20 minutes at a temperature of about 70° F. or lower; wherein the detergent concentrate consists of from about 65% to about 90% by weight of one or more surfactants; one or more humectants; a coalescing solvent which has hydrophilic-lipophilic balance (HLB) value from about 7 to about 9, wherein the ratio of the one or more humectants to the coalescing solvent is more than 1; less than about 15% of water; one or more digestive enzymes; and optionally: a non-phosphate builder and one or more fragrant compounds; wherein the one or more humectants are one or more alkyl alcohols and the coalescing solvent is a propylene based glycol ether; the capsule comprises a film having at least one polymer or meltable solid or both, at least one plasticizer, and at least one temperature adjusting agent.

2. The cleaning packet of claim 1, wherein the at least one polymer is a natural polymer, a synthetic polymer, or a combination thereof.

3. The cleaning packet of claim 1, wherein the at least one polymer is selected from the group consisting of gelatins, cellulose based polymers, natural gums, polyvinyl alcohol, poly (ethylene oxide) polymers, starches, water soluble carbohydrates, sea weed extracts, and combinations thereof.

4. The cleaning packet of claim 3, wherein the natural gums are selected from the group consisting of beta-glucan, chicle gum, dammar gum, gellan gum, glucomannan, guar gum, gum arabic, gum ghatti, gum tragacanth, karaya gum, locust bean gum, mastic gum, psyllium seed husks, spruce gum, tara gum, xanthan gum, and a combination thereof.

5. The cleaning packet of claim 3, wherein the seaweed extracts are selected from the group consisting of agar, alginic acid, carrageenan, sodium alginate, and a combination thereof.

6. The cleaning packet of claim 1, wherein the at least one plasticizer is selected from the group consisting of glycerine, water, propane diol, sorbitol, polyol, and a combination thereof.

7. The cleaning packet of claim 1, wherein the at least one temperature adjusting agent is selected from the group consisting of an organic acid or its salt or a mixture thereof, starch, modified starch, a hygroscopic sugar alcohol, and a combination thereof.

8. The cleaning packet of claim 7, wherein the organic acid is acetic acid, citric acid, succinic acid, maleic acid, fumaric acid, malic acid, tartaric acid, tannic acid, lactic acid, glycolic acid, or a combination thereof.

9. The cleaning packet of claim 8, wherein the organic acid is citric acid.

10. The cleaning packet of claim 7, wherein the hygroscopic sugar alcohol is selected from the group consisting of maltitol, sorbitol, maltodextrin, erythritol, arabitol, xylitol, mannitol, isomalt, lactitol, and a combination thereof.

11. The cleaning packet of claim 1, wherein the film comprises from about 10% to about 90% by weight of the at least one polymer, from about 10% to about 60% of the at least one plasticizer, and from about 0.1% to about 15% by weight of at least one temperature adjusting agent.

12. The cleaning packet of claim 1, wherein the water is less than about 10%.

13. The cleaning packet of claim 1, wherein the one or more surfactants are non-ionic surfactants, anionic surfactants, cationic surfactants, amphoteric surfactants, zwiterionic surfactants, or combinations thereof.

14. The cleaning packet of claim 1, wherein the one or more surfactants are non-ionic surfactants, anionic surfactants, or combinations thereof.

15. The cleaning packet of claim 14, wherein the non-ionic surfactants are alkoxylates of saturated or mono- or polyunsaturated linear or branched-chain alcohols having from 10 to 22 carbon atoms, and the anionic surfactants are alkyl or alkenyl sulfates or sulfonates, the alkyl or alkenyl ether sulfates or sulfonates, or combinations thereof wherein the alkyl or alkenyl group has from 8 to 22 carbon atoms.

16. The cleaning packet of claim 1, wherein the one or more alkyl alcohols are selected from the group consisting of methanol, ethanol, 1,3 propane diol, glycerin, propylene glycol, sorbitol, and combinations thereof.

17. The cleaning packet of claim 1, wherein the non-phosphate builder is an alkyl cellulose derivative, a hydroxyalkyl cellulose derivative, a carboxyalkyl cellulose derivative or its alkali salt or a mixture thereof, or a combination thereof.

18. The cleaning packet of claim 17, wherein the non-phosphate builder is sodium salt of carboxy methyl ether cellulose.

19. The cleaning packet of claim 1, wherein the one or more digestive enzymes are selected from the group consisting of one or more protease enzymes, one or more amylase enzymes, one or more cellulase enzymes, one or more lipase enzymes, one or more manninase enzymes, and combinations thereof.

20. The cleaning packet of claim 1, wherein the non-phosphate builder is from about 0.5% to about 1.5% by weight.

21. The cleaning packet of claim 1, wherein the one or more digestive enzymes are from about 1.5% to about 3.5% by weight.

22. The cleaning packet of claim 1, wherein the fragrant compounds are from about 0.2% to about 3% by weight.

* * * * *